US008723666B2

(12) United States Patent
Edwards

(10) Patent No.: US 8,723,666 B2
(45) Date of Patent: May 13, 2014

(54) BUILDING HAVING AN EMERGENCY INFORMATION FACILITY

(75) Inventor: Stuart Graham Edwards, Ashford (GB)

(73) Assignee: Stuart Graham Edwards, Kent (GB)

( * ) Notice: Subject to any disclaimer, the term of this patent is extended or adjusted under 35 U.S.C. 154(b) by 0 days.

(21) Appl. No.: 13/261,591

(22) PCT Filed: Aug. 9, 2011

(86) PCT No.: PCT/GB2011/001199

§ 371 (c)(1),
(2), (4) Date: Feb. 11, 2013

(87) PCT Pub. No.: WO2012/022930

PCT Pub. Date: Feb. 23, 2012

(65) Prior Publication Data

US 2013/0139448 A1 Jun. 6, 2013

(30) Foreign Application Priority Data

Aug. 16, 2010 (GB) ..... 1013711.5
Nov. 16, 2010 (GB) ..... 1019378.7
Jun. 10, 2011 (GB) ..... 1109726.8

(51) Int. Cl.
*G08B 19/00* (2006.01)

(52) U.S. Cl.
USPC ..... 340/522; 52/1

(58) Field of Classification Search
USPC ..... 52/1; 340/521, 522, 525, 500, 539.11
See application file for complete search history.

(56) References Cited

U.S. PATENT DOCUMENTS

| | | | | |
|---|---|---|---|---|
| 4,803,632 | A * | 2/1989 | Frew et al. | 705/412 |
| D358,540 | S * | 5/1995 | Trempala | D8/330 |
| 7,924,149 | B2 * | 4/2011 | Mendelson | 340/539.11 |
| 8,067,715 | B2 * | 11/2011 | Peterson et al. | 219/386 |
| 2006/0230270 | A1 | 10/2006 | Goffin | |
| 2008/0218331 | A1 | 9/2008 | Baillot | |
| 2013/0205257 | A1 * | 8/2013 | Albright | 715/810 |

FOREIGN PATENT DOCUMENTS

WO WO 2009/054734 4/2009

OTHER PUBLICATIONS

Gerada Premises Information Box, Jul. 2010, Archived Webpage.*

* cited by examiner

*Primary Examiner* — Jeanette E Chapman
*Assistant Examiner* — Daniel Kenny
(74) *Attorney, Agent, or Firm* — Iandiorio Teska & Coleman LLP

(57) ABSTRACT

A building (2) having an information facility for use in an emergency and for enabling emergency services to obtain information on the building (2) likely to be necessary for use in tackling the emergency, and the building (2) being such that: (i) the information on the building (2) is accessed via an information container (4); (ii) the information container (4) is on an outside part of a building; (iii) the information container (4) comprises a body (8), a door (10) for closing the body (8), and control means (12) for accessing the information on the building (2); (iv) the information on the building (2) is stored in memory means (14); and (v) the control means (12) electronically accesses the information in the memory means (14).

18 Claims, 5 Drawing Sheets

| | |
|---|---|
| GF | 6 |
| LGF | 7 |
| 1 | 8 |
| 2 | 9 |
| 3 | 10 |
| 4 | 11 |
| 5 | 12 |
| 5 | ⇧ |

BUILDING HAVING AN EMERGENCY INFORMATION FACILITY

This invention relates to a building having an emergency information facility. More especially, this invention relates to a building having an information facility for use in an emergency and for enabling emergency services to obtain information on the building likely to be necessary for use in tackling the emergency.

Buildings having an emergency information facility are known. More specifically, it is known for buildings to be provided with an information container on an outside part of the building. The information container contains information for use in an emergency and for enabling emergency services to obtain information on the building likely to be necessary for use in tackling the emergency. The information is either in paper form or on one or more compact discs. The provision of the information in paper form is not convenient in that the paper can deteriorate over time in the information container, for example as the result of moisture ingress into the information container. Further, environmental conditions may make it difficult to read the information on the paper in the vicinity of the building, for example if the building is on tire. Further, if the building is large, then the quantity of paper involved may be too large to fit into the information container. Information provided on compact discs, for example on CD-ROMs, is more conveniently stored but then the compact discs have to be taken to an appropriate playing point in order for the information on the compact discs to be accessed. Such a playing point may not be readily available and/or may be not in the immediate vicinity of the building in which the emergency is taking place.

It is an aim of the present invention to obviate or reduce the above mentioned problems.

Accordingly, the present invention provides a building having an information facility for use in an emergency and for enabling emergency services to obtain information on the building likely to be necessary for use in tackling the emergency, and the building being such that;

(i) the information on the building is accessed via an information container;

(ii) the information container is on an outside part of the building;

(iii) the information container comprises a body, a door for closing the body, and-control means for accessing the information on the building;

(iv) the information on the building is stored in memory means;

(v) the control means electronically accesses the information in the memory means;

(vi) the information container includes at feast one detachable electronic device for being taken into the building by a person tackling the emergency;

(vii) the detachable electronic device comprises an inertial navigation system and at least some of the information on the building, whereby the person tackling the emergency and using the detachable electronic device is able to find their way around the building;

(viii) the detachable electronic device enables the person tackling the emergency to be able to stay in two-way contact with the information container and also with other detachable electronic devices if more than one of the detachable electronic devices is in the information container; and (ix) the inertial navigation system utilizes a radio frequency identification device and/or Wi-Fi, whereby the person tackling the emergency is able to be tracked by another person outside the building.

With the building of the present invention, the information is easily available via the control means which electronically accesses the memory means. There are no problems with information on paper becoming wet, or blowing away in strong winds. There is no need to find an access point for compact discs. The information container may be located on an outside part of the building in a visible yet secure position.

The memory means may be located in or on the building. In this case, the memory means may be located in the control box. Alternatively, the memory means may be located somewhere in the building, for example in a basement part of the building.

In an alternative embodiment of the invention, the memory means may be located remote from the building. In this case, the memory means may be located in a remote control centre.

In all embodiments of the invention, the control means may comprise a touch screen. In this case, the building may be one in which the touch screen is part of a computer, and in which the memory means is also part of the computer. If desired, the control means may be other than a touch screen.

The building may be one in which the information container includes a coordination control facility whereby a person in charge of the emergency is able to coordinate efforts in tackling the emergency. For example, if the building is on fire, then the person in charge of the emergency may be the Chief Fire Fighter. The information container may be regarded as a computer-based building-safety information container. The information container may be a box or any other suitable and appropriate type of container.

Preferably, the coordination control facility is in the memory means. If desired however the coordination control facility may be in a separate memory means, or in a separate device.

The two-way contact may be radio and/or visual contact. Such two-way contact is extremely useful in emergency situations such for example as fires or occupation of buildings by terrorists.

Preferably the detachable electronic device is a hand-held slate tablet PC. Other types of detachable electronic device may be employed.

The detachable electronic device may include a global positioning satellite facility (GPS). The GPS may enable a person at the information container to be able to determine the position in the building of the person carrying the detachable electronic device. The detachable electronic device may include other types of fireman-tracking devices. Thus, for example, it is mentioned that the detachable electronic device may include a radio frequency identification device (RFID) and/or Wi-Fi for facilitating tracking of a person tackling the emergency, for example a fire-fighter. The detachable electronic device may alternatively be an inertial navigation system.

The control means may advantageously have a link facility enabling the control means to engage at least one building management system in the building. The control means may then access the building management system and remotely operate the management system, for example to stop water and/or gas and/or supplies, or to commence the operation of fire sprinklers.

The information container advantageously includes anti-condensation means. The anti-condensation means may stop condensation on electronic components such as could cause the electronic components to fail. The anti-condensation means may be an electrical heater means and/or a chemical water-absorbing means.

The information container may include a screen for providing a view of what is happening in the building. The screen may obtain viewing data from video cameras which are fixed in the building. Alternatively or in addition, the screen may obtain viewing data from a video camera which is in the detachable electronic device and which therefore moves with the person tackling the emergency in the building.

Preferably, the door is locked and unlocked by a universally used security key. Thus, for example, the key may be a fire brigade key of a certain designated number. The door may be locked and unlocked by other means if desired so that, for example, the door may be locked and unlocked by a unique security key and/or by a combination.

The outside part of the building which supports the information container may be adjacent the main entrance.

If desired, the building may be provided with more than one of the information containers. In this case, the building may be such that there is one of the information containers at a front entrance of the building, and one of the information containers at a rear entrance of the building.

The information on the building may be any suitable and appropriate information of the type that may be required for use in an emergency and for enabling emergency services to obtain information on the building likely to be necessary for use in tackling the emergency. Thus, for example, the information on the building may include plans of the building. Where the building is a multi-storey building, then the information may include detailed plans of the layout of each floor of the building. The information on the building may also include information on water services, gas services, electricity services, entrances to the building, and structural materials used in the construction of the building.

The building may be any suitable and appropriate building of any suitable and appropriate size and/or complexity. Thus, for example, the building may be a large hotel, a corporate office, a public building, a healthcare building, a residential care building, an educational building, a retail building, a warehouse, a historic building, a station, an airport, or a high rise block of flats.

The emergency services may be any emergency services appropriate for the emergency including the fire brigade, the ambulance service, the military, or the SAS.

Embodiments of the invention will now be described solely by way of example and with reference to the accompanying drawings in which.

Figure 1:
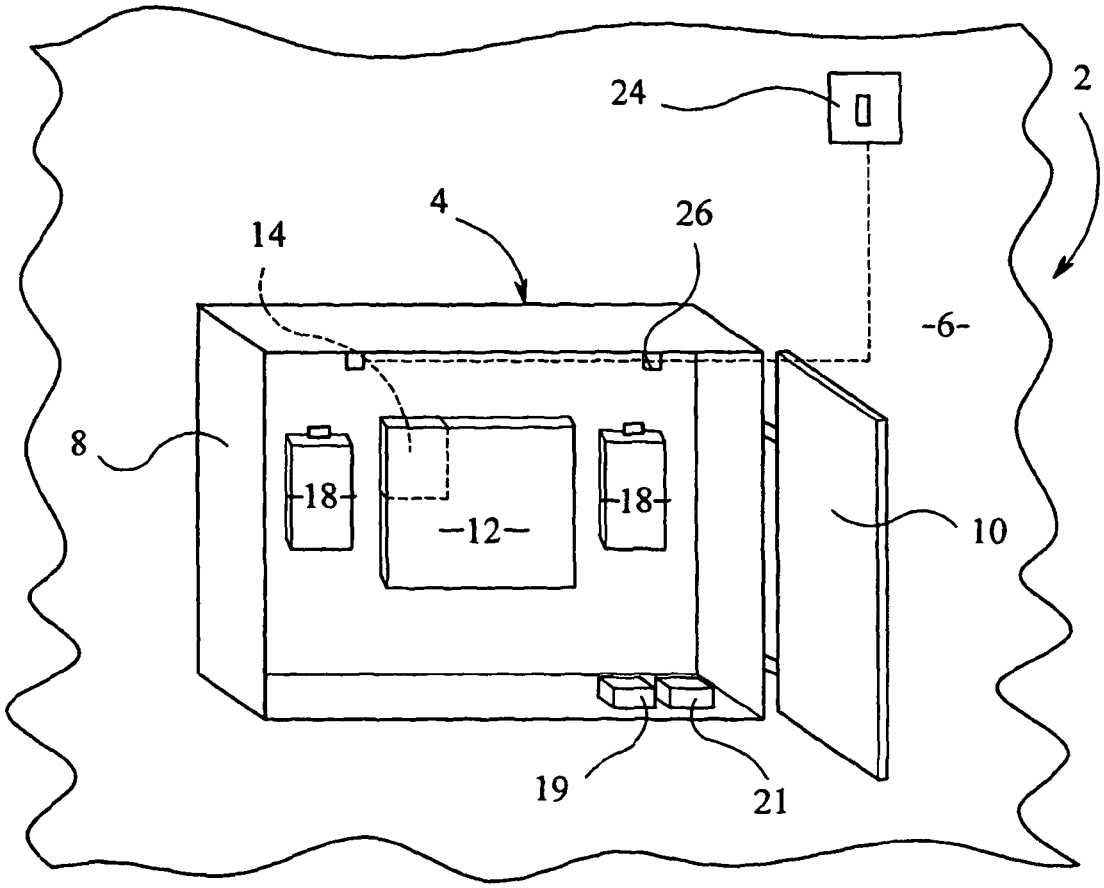
FIG. 1 is a perspective view of a building having an information container on an outside part of the building.
Figure 2:
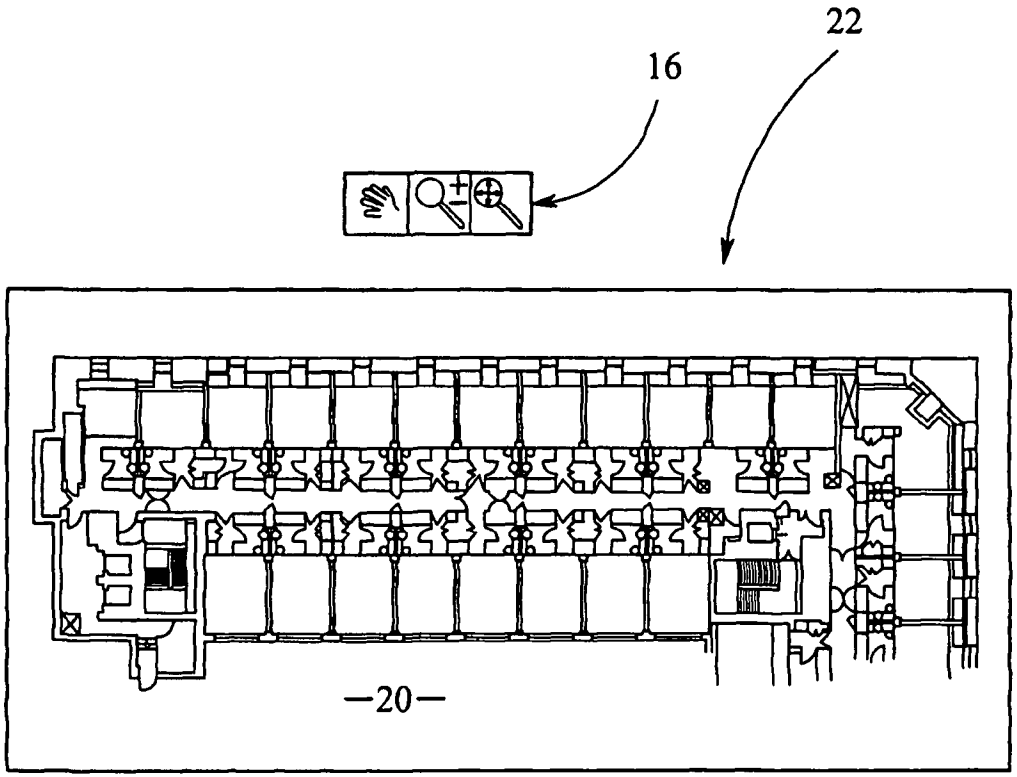
FIG. 2 shows a plan view of a floor of the building, a touch screen, and a number of floors in the building.
Figure 3:
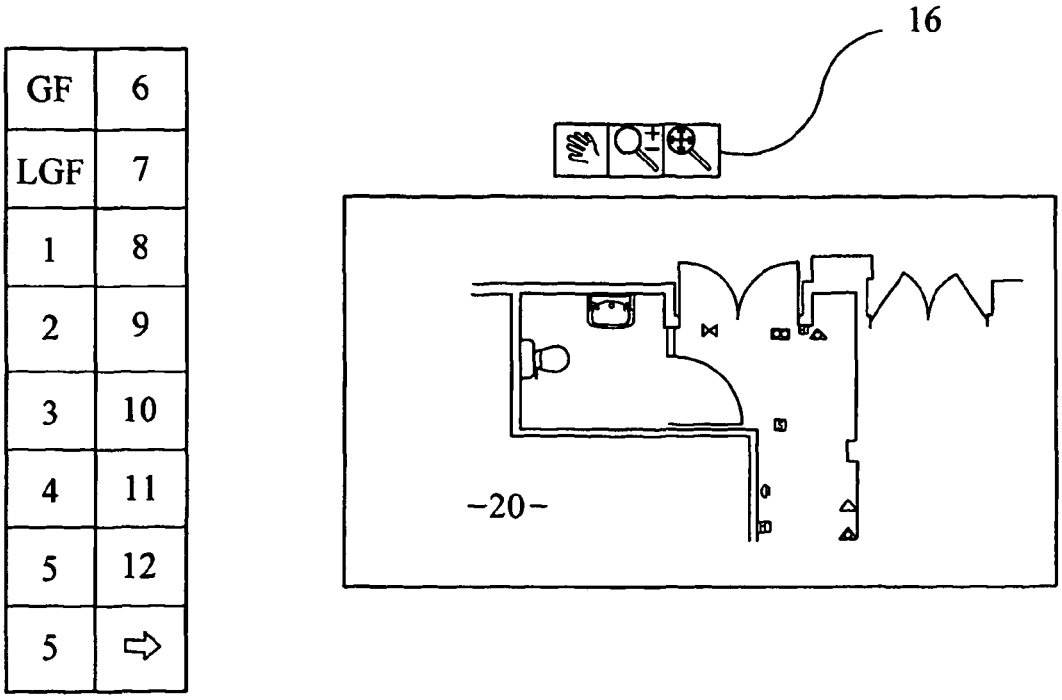
FIG. 3 is an enlarged view of FIG. 2.

Referring to FIGS. 1-3, there is shown a building 2 having an information facility for use in an emergency and for enabling emergency services to obtain information on the building likely to be necessary for use in tackling the emergency. The building 2 is such that the information on the building 2 is accessed via an information container 4. The information container 4 is on an outside part 6 of the building 2.

As shown in FIG. 1, the information container 4 comprises a body 8, a door 10 for closing the body 8, and control means 12 for accessing the information on the building 2. The information on the building 2 is stored in memory means 14. The control means 14 electronically accesses the information in the memory means 14. The memory means 14 is located in the control means 12 in the information container 4. If desired, the memory means 14 could be provided elsewhere in the body 8 of the information container 4, or the memory means 14 could alternatively be provided remote from the information container 4, for example in the building 2 or remote from the building 2.

Preferably, the control means comprises a touch screen 16. The touch screen 16 may be part of a computer, and the memory means 14 may also be part of the computer.

The information container 4 may include a coordination control facility whereby a person in charge of the emergency is able to coordinate efforts in tackling the emergency. The person in charge of the emergency may be, for example, a chief fire fighter in the case of an emergency in the form of the building 2 being on fire. The coordination control facility is stored in the memory means 14. The coordination control facility could alternatively be store in a separate memory means.

The information container 4 includes two detachable electronic devices 18 for being removed from the information container 4, and for being taken into the building by a person tackling the emergency. Each detachable electronic device 18 is each such that it contains at least some of the information on the building so that the person tackling the emergency and using the detachable electronic device is able to find their way around the building. The detachable electronic device 18 may enable the person tackling the emergency to be able to stay in two-way contact with the information container 4 and also with other detachable electronic devices 18. The detachable electronic device 18 is preferably a hand-held slate tablet PC.

The detachable electronic device 18 advantageously includes GPS. Thus a person at the information container 4 is able to determine the position in the building of the person carrying the detachable electronic device 18.

The control means 12 has a link facility enabling the control means 12 to engage at least one building management system in the building 2. Thus the control means is able to control the building management system in the event of an emergency and, for example, cause the management system to turn on or off as may be required one or more services such for example as water, gas, electricity. and fire sprinklers.

The information container preferably includes anti-condensation means for preventing a build up of condensation on the electronic components within the information container 4, and such as could cause the electronic components to fail. The anti-condensation means may be an electrical heater means 19 and/or a chemical water-absorbing means 21.

The information container may include a screen 20 for providing a view of what is happening in the building. Thus, for example, in FIG. 2 it will be seen that the screen 20 is able to provide a plan view of a floor of the building. The control means 12 includes a magnification facility so that a part 22 of the floor of the building shown in FIG. 2 is able to be magnified as shown in FIG. 3. If desired, the screen 20 may obtain viewing data from video cameras (not shown) which are fixed in the building 2. Alternatively or additionally, the screen 20 may obtain viewing data from a video camera (not shown) which is in the detachable electronic device 18 and which therefore moves with the person tackling the emergency inside the building 2.

The door 10 is locked and unlocked by a universally used security key, for example a fire brigade key having an appropriate FB number, for example a Fireman's Override Drop Key Switch 24 which causes locking and unlocking of a magnetic lock 26.

The information on the building may be plans of each floor of the building 2, including room layout and access points. The information may include information on water services, gas services, electricity services, main entrances, and structural materials used in the construction of the building.

Figure 4:
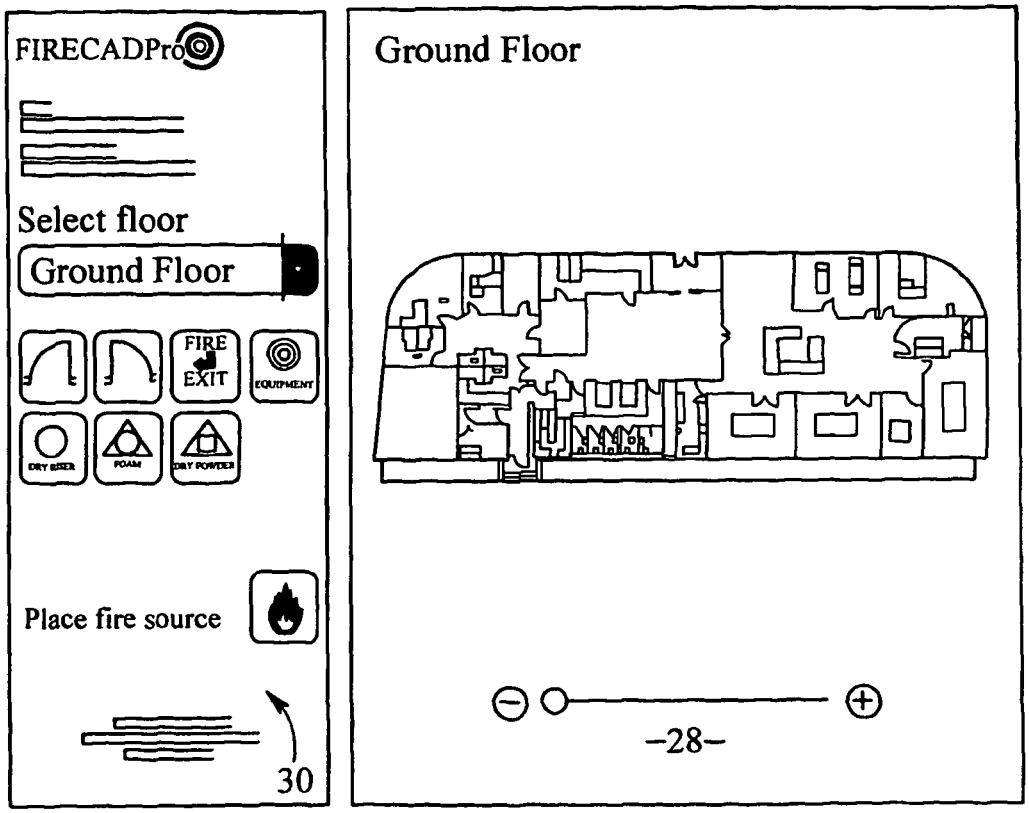
FIG. 4 is a plan view of a ground floor of a building.
Figure 5:
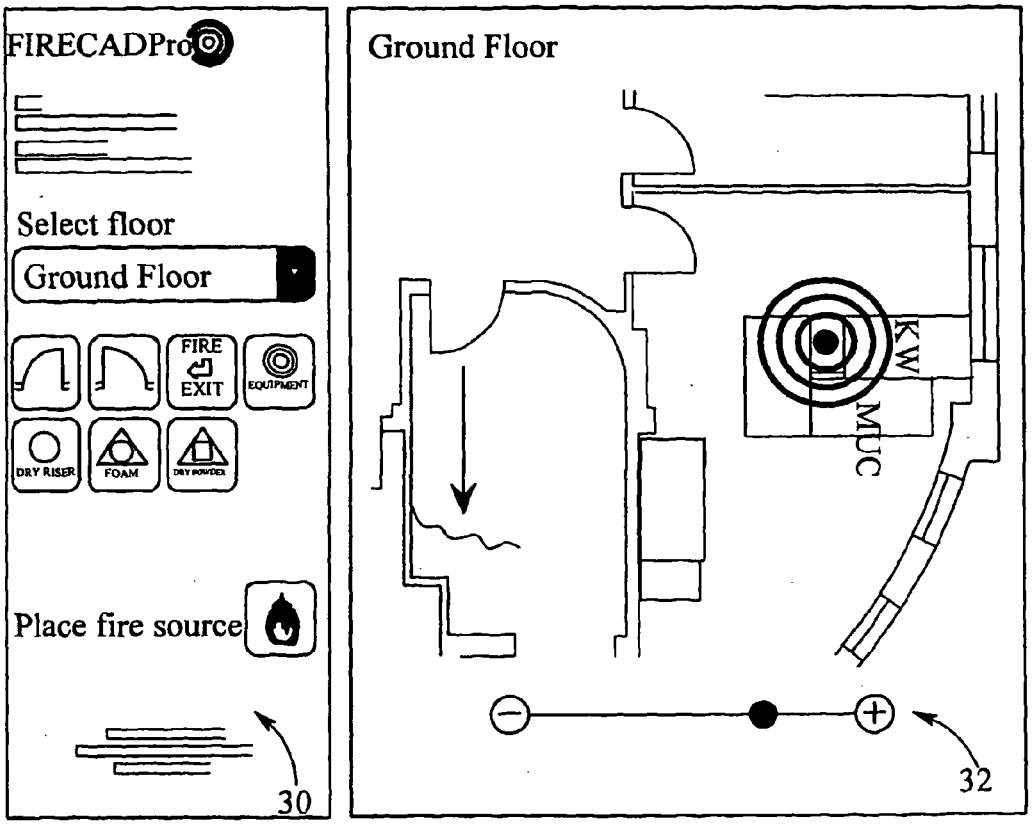
FIG. 5 shows an enlarged part of FIG. 4.

FIG. 4 is a view like FIG. 2 but shows a ground floor 28 brought onto a screen in an information container by means of control means 30. FIG. 5 shows an amplified part 32 of the ground floor 28 shown in FIG. 4.

By way of example only, the apparatus used in the building of the present invention may be regarded as preferably comprising the following six main elements.

1. The Information Container

The information container may be a highly secure, weather proof vandal resistant enclosure unit that is unobtrusive and blends in with the building exterior. The information container balances out the needs and requirements of fire services with those of building owners. The information container may be provided in a number of different finishes such for example as black, brick, silver or white. Any contents within the information container may normally be such that they are only ever able to be accessed by authorised personnel, for example representatives of a fire services, a maintenance company or a management company. The information container may have a locking system with a high security locking mechanism. The locking mechanism may be key and/or combination based.

The information container may include a sophisticated anti-condensation heater system which is able to keep the information container with an internal ambient temperature of 15° C. throughout the year, along with an appropriately specified uninterrupted power supply unit. Battery power for the information container may be employed, and, in this case, any battery or batteries employed may be rechargeable, for example using solar energy.

2. "Fixed" Touch Screen Computer/Monitor

A touch screen monitor may be employed with any desired size, for example 17 inch or 19 inch. The monitor may use protective capacity touch (PCT) touch screen technology. This technology gives good resolution and enables the use of 6 mm tempered safety glass that is able to be weather proof and vandal proof. This technology will also allow for the gloved fingers of fire fighters to be sensed. Another main benefit of a protective capacity touch-based touch screen technology is that there are no moving parts involved and once the system is calibrated, it cannot drift. The life span of a protective capacity touch-based touch screen technology may be greater than 50 million touches.

The monitor, like all other elements of the apparatus, may be arranged to be impact resistive, able to resist the ingress of dust, and protected against jets of water from any direction.

3. Operating Software

Generic operating software may be employed that enables the simple upload of existing CAD plans, allowing the end user to pan and zoom their way through the plans in an efficient manner.

4. Removable Tablet-Style "Hand-Held" Computers

One, two or more removable tablet-style "hand-held" computers may be provided in the information container to replicate exactly a fixed touch screen computer. Each removable computer may also utilise the same operating software and projective capacity touch-based touch screen technology as the fixed touch screen computer. The or each removable computer may be constructed to be rugged fire-resistant, and it may advantageously also contain a tracking device.

5. Tracking Device

Any suitable and appropriate tracking device may be employed. A presently preferred tracking device is an inertial navigation system. An inertial navigation system may be an efficient and cost effective way of tracking fire fighters inside a building. A presently preferred inertial navigation system is that manufactured by Seer Technology of the USA and marketed as a Naviseer personal tracking system. The Naviseer personal tracking system may contain a GSM/GPRS cell protocol radio. Location data may be transmitted from the Naviseer unit to a personal computer or a laptop with Seer visualisation software via existing public mobile telephone networks.

6. Portable Tracking Units

The apparatus used in the building of the present invention may employ portable mini Naviseer tracking units. More specifically, in addition to the Naviseer tracking tags located within the or each removable computer, there may be supplied a number of additional mini Naviseer tracking tags, for example contained within a small box inside the information container. These additional mini Naviseer tracking tags can be allocated by an Incident Commander to fire fighters that enter a building and who are not carrying one of the removable tablet computers.

The apparatus used in the present invention is advantageously able to identify potential hazardous materials stored or used within the building. Such materials may be substances that might already be involved in a fire and causing hazards to rescue workers, or potentially harming the environment, or substances that might become involved and cause rapid fire spread or explosion risk. The fire commander is easily able to locate such hazards and take appropriate action. Straight forward CAD building plans enable a emergency service to work out how to get quickly and safely to the right location to sort out whatever problem or problems exist at that location. Building plans are also able to give the emergency services a good idea of how the building structure will behave under the stress of fire or damage caused by an explosion. This can help minimise further building damage and also maximise on peoples' safety. Touch screen technology may be employed, preferably using a pan and zoom format.

The apparatus may considerably assist fire and emergency services upon arrival at an incident, particularly at large and complex buildings. The early phases of any fire or emergency situation are critical. The fire service has to arrive on site, assess the situation, identify and evaluate the risks to life and property, and predict how the emergency is likely to develop. This is a period of intense and often stressful activity for fire crews and especially so for an incident commander, who must make quick decisions on how best to bring the incident under control. The apparatus provided by the present invention may enable the fire service to read building plan schematics in a pan and zoom touch screen format. The plans may be such that they show key features of the building relevant to an emergency incident. For example, the plans may show the location of fire exits, fire equipment, fire risers, sprinkler systems, along with any established fire risk assessment information. The plans may also show salvage plan information unique to a particular building. There are many large and complex buildings that contain rare and valuable artifacts such for example as paintings, antiques or other historical items. The information provided by the present invention is able to help disclose the exact location of these artifacts, and prioritise their importance to the building owner. The information container may be an externally located, secure, shallow metal box.

It is to be appreciated that the embodiments of the invention described above with reference to the accompanying drawings have been given by way of example only and that modifications may be effected. Thus, for example, the shape of the information container 4 may be different from that shown. The information container 4 may be positioned where desired on the outside of the building 2. Individual components shown in the drawings are not limited to use in their drawings and they may be used in other drawings and in all aspects of the invention.

The invention claimed is:

1. A building having an information facility for use in an emergency and for enabling emergency services to obtain information on the building likely to be necessary for use in tackling the emergency, and the building being such that:

(i) the information on the building is accessed via an information container;

(ii) the information container is on an outside part of the building;

(iii) the information container comprises a body, a door for closing the body, and control means for accessing the information on the building;

(iv) the information on the building is stored in memory means;

(v) the control means electronically accesses the information in the memory means;

(vi) the information container includes at least one detachable electronic device for being taken into the building by a person tackling the emergency, (vii) the detachable electronic device comprises an inertial navigation system and at least some of the information on the building, whereby the person tackling the emergency and using the detachable electronic device is able to find their way around the building;

(viii) the detachable electronic device enables the person tackling the, emergency to be able to stay in two-way contact with the information container and also with other detachable electronic devices if more than one of the detachable electronic devices is in the formation container; and (ix) the inertial navigation system utilizes a radio frequency identification device and/or Wi-Fi, whereby the person tackling the emergency is able to be tracked by another person outside the building.

2. A building, according to claim 1 in which the memory means is located in or on the building.

3. A building according to claim 2 in which the memory means is located in the information container.

4. A building according to claim 1 in which the memory means is located remote from the building.

5. A building according claim 1 in which the control means comprises a touch screen.

6. A building according to claim 5 in which the touch screen is part of a computer, and in which the memory means is also part of the computer.

7. A building according to claim 1 in which the information container includes a coordination control facility whereby a person in charge of the emergency is able to coordinate efforts in tackling the emergency.

8. A building according to claim 7 in which the coordination control facility is in the memory means.

9. A building according to claim 1 in which the detachable electronic device is a hand-held slate tablet PC.

10. A building according to claim 1 in which the detachable electronic device includes GPS.

11. A building according to claim 1 in which the control means has a link facility enabling the control means to engage with at least one management system in the building.

12. A building according to claim 1 in which the information container includes anti-condensation means.

13. A building according to claim 12 in which the anti-condensation means is an electrical heater means and/or a chemical water-absorbing means.

14. A building according to claim 1 in which the information container includes a screen for providing a view of what is happening in the building.

15. A building according to claim 14 in which the screen obtains viewing data from video cameras which are fixed in the building.

16. A building according to claim 1 in which the information container includes a screen for providing a view of what is happening in the building, and in which the screen obtains viewing data from a video camera which is in the detachable electronic device and which therefore moves with the person tackling the emergency inside the building.

17. A building according to claim 1 in which the door is locked and unlocked by a universally used security key.

18. A building according to claim 1 in which there are more than one of the information containers.

* * * * *